US005626174A

United States Patent [19]

Schaffner

[11] Patent Number: 5,626,174

[45] Date of Patent: May 6, 1997

[54] RADIATOR FUNNEL AND ADAPTER MEANS FOR SPILL PREVENTION

[76] Inventor: John Schaffner, 314 Weatherby Way, Bismarck, N. Dak. 58501

[21] Appl. No.: 419,116

[22] Filed: Apr. 10, 1995

[51] Int. Cl.[6] ..... B67C 11/00

[52] U.S. Cl. ..... 141/386; 141/98; 141/332; 141/340; 141/345; 141/383

[58] Field of Search ..... 141/98, 297–300, 141/331, 332, 340–342, 344, 345, 364, 383, 385, 386

[56] References Cited

U.S. PATENT DOCUMENTS

| | | | |
|---|---|---|---|
| 606,927 | 7/1898 | Keene | 141/342 X |
| 1,174,553 | 3/1916 | Errington | 141/297 |
| 2,543,724 | 2/1951 | Iwanowski | 141/300 X |
| 2,584,216 | 2/1952 | Morrison | 141/300 |
| 2,811,181 | 10/1957 | Correll | 141/340 |
| 3,177,907 | 4/1965 | Baldi | 141/300 |
| 4,494,585 | 1/1985 | Waldecker | 141/98 |
| 4,856,568 | 8/1989 | Murphy | 141/337 |
| 5,004,024 | 4/1991 | Rezmer et al. | 141/298 |
| 5,042,698 | 8/1991 | Fessell | 222/481.5 |

*Primary Examiner*—J. Casimer Jacyna
*Attorney, Agent, or Firm*—David A. Lingbeck

[57] ABSTRACT

A radiator funnel and adapter to prevent spillage comprises a funnel having a fluid receiving body and a spout through which fluid is dispensed; an adapter having a tubular member, a sealing flange, a flexible seal member, and a cap abutment member; a cap having a hole for receiving the top end of the tubular member and the spout which is engageably and sealingly inserted in the tubular member; and a stopper means having a stem, a plug portion at one end of the stem, and a handle at the other end to plug the bore through the spout. The adapter fits in the fill opening of the radiator and the cap fastens over the fill opening of the radiator and urges the flexible seal member and the sealing flange against the recessed ledge in the fill opening to substantially provide a seal between the adapter and the fill opening so that as fluid is poured into the radiator, the fluid won't spill out of radiator as it commonly bubbles up through the fill opening of the radiator.

4 Claims, 3 Drawing Sheets

RADIATOR FUNNEL AND ADAPTER MEANS FOR SPILL PREVENTION

BACKGROUND OF THE INVENTION

This invention relates to a radiator funnel and adapter means for preventing fluid spillage commonly occurring during the filling of the radiator with coolant and anti-freeze fluids.

Funnels have been in existence for years and have been used to facilitate the filling of fluids in all types of receptacles including putting oil in the engine blocks of vehicles and even putting coolants and antifreeze fluids in the radiators of vehicles. The conventional funnel has a generally conical-shaped body into which fluids as such are poured and a spout integrally extending therefrom, through which the fluids drain into containers. None of the prior art is adapted to fully and completely prevent any possibility of spillage of fluids out of the containers. The spouts of the funnels of the prior art are dimensioned to extend or fit in the fill opening of the containers.

One known prior art is a FUNNEL APPARATUS, U.S. Pat. No. 4,856,568, which comprises a receiving member, an accordion-like spout extending from the bottom of the receiving member, and a cap or plug for fitting in the fill opening of the fluid receiving members or for fastening to the fill opening.

Another known prior art is a SELF-SUPPORTING FUNNEL, U.S. Pat. No. 4,804,026, invented by Thomas F. Bailey and which comprises a conical body, a spout extending therefrom, and three straps spaced about the periphery of the body and having notches to support the funnel in a vertical relation to an angularly disposed neck of a tank or container.

Another known prior art is a SEALABLE FUNNEL FOR MEASUREMENT AND SPILL PREVENTION, U.S. Pat. No. 5,004,024, invented by Resmer et al and which comprises a funnel body, a stem portion, a cup portion, a core portion coaxially disposed within the funnel body and having an upper handle portion and an enlarged lower sealing portion which sealing fits in the bore.

Another known prior art is an EASY POUR SPOUT, U.S. Pat. No. 5,042,698, invented by Eric Fessell.

None of the prior art describes nor suggests an adapter means dimensioned to snugly and sealingly fit in the fill opening of the radiator with a cap capable of being screwed onto the mouth of the fill opening and urging against the adapter means to make sure that the adapter means seals about the mouth of the fill opening.

SUMMARY OF THE INVENTION

The present invention comprises a funnel having a fluid receiving body and a spout integrally extending from the fluid receiving body; an adapter means having a tubular member adapted to extend into the fill opening of the radiator, an annular sealing flange, a flexible seal member mounted about the tubular member and disposed against the sealing flange, a cap abutment member spaced from the sealing flange along the tubular member, and a bore through the tubular member; a cap having a hole through the top thereof, for securing to the fill opening and for sealingly urging the adapter means into engagement with the recessed ledge inside the fill opening; and a stopper means having a stem, a plug portion integrally extending at one end thereof, and a handle integrally connected at the other end thereof, to close the bore through the spout of the funnel.

One objective of the present invention is to provide a radiator funnel and adapter means which substantially prevents any radiator fluid from seeping up through the fill opening and between the adapter means and the fill opening and the adapter means and the spout and spilling out of the radiator during the filling thereof.

Another objective of the present invention is to provide a radiator funnel and adapter means which is adaptable to any size of fill opening of any radiator and is convenient and easy to secure in the fill opening of the radiator.

Also, another objective of the present invention is to provide a radiator funnel and adapter means whereupon the spout through the funnel can be closed off to prevent any leftover fluid in the funnel from dripping out of the spout.

Further objectives and advantages of the present invention will become apparent as the description proceeds and when taken in conjunction with the accompanying drawings wherein:

DETAILED DESCRIPTION OF THE INVENTION

Figure 1:
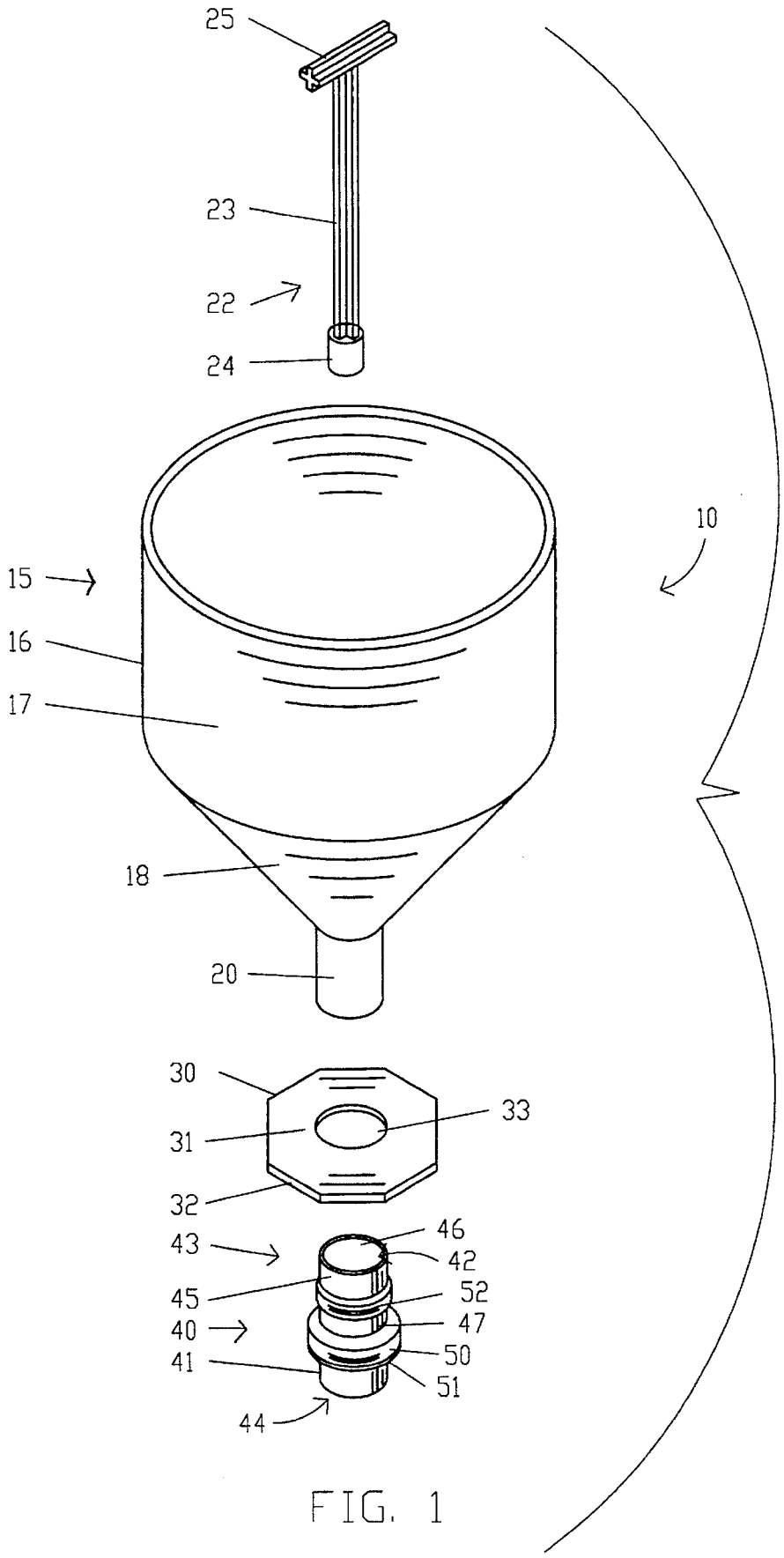
FIG. 1 is an exploded top perspective view of the radiator funnel and adapter means.
Figure 2:
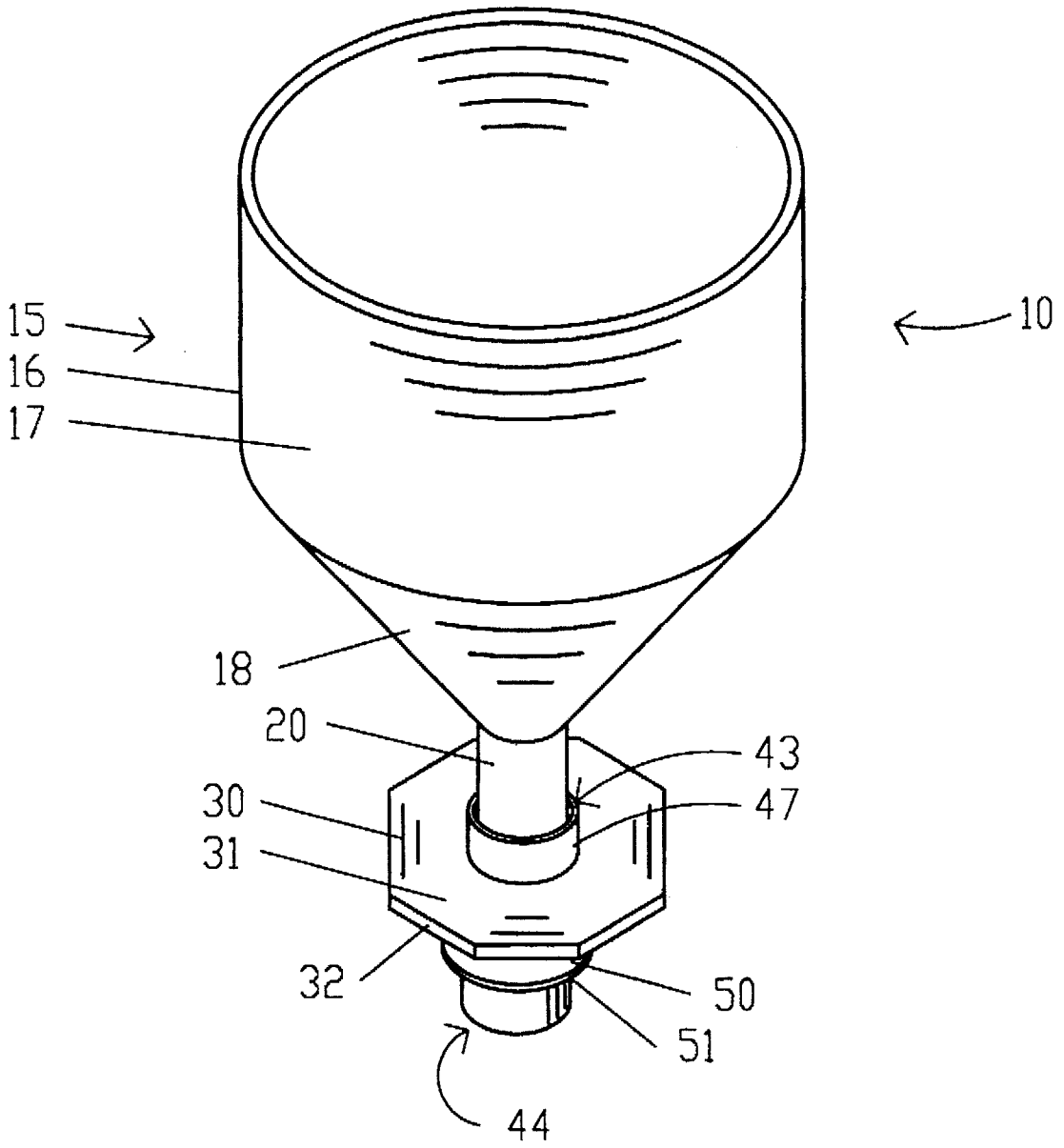
FIG. 2 is a top perspective view of the radiator funnel and adapter means with the spout engaged in the adapter means and without the stopper means.
Figure 3:
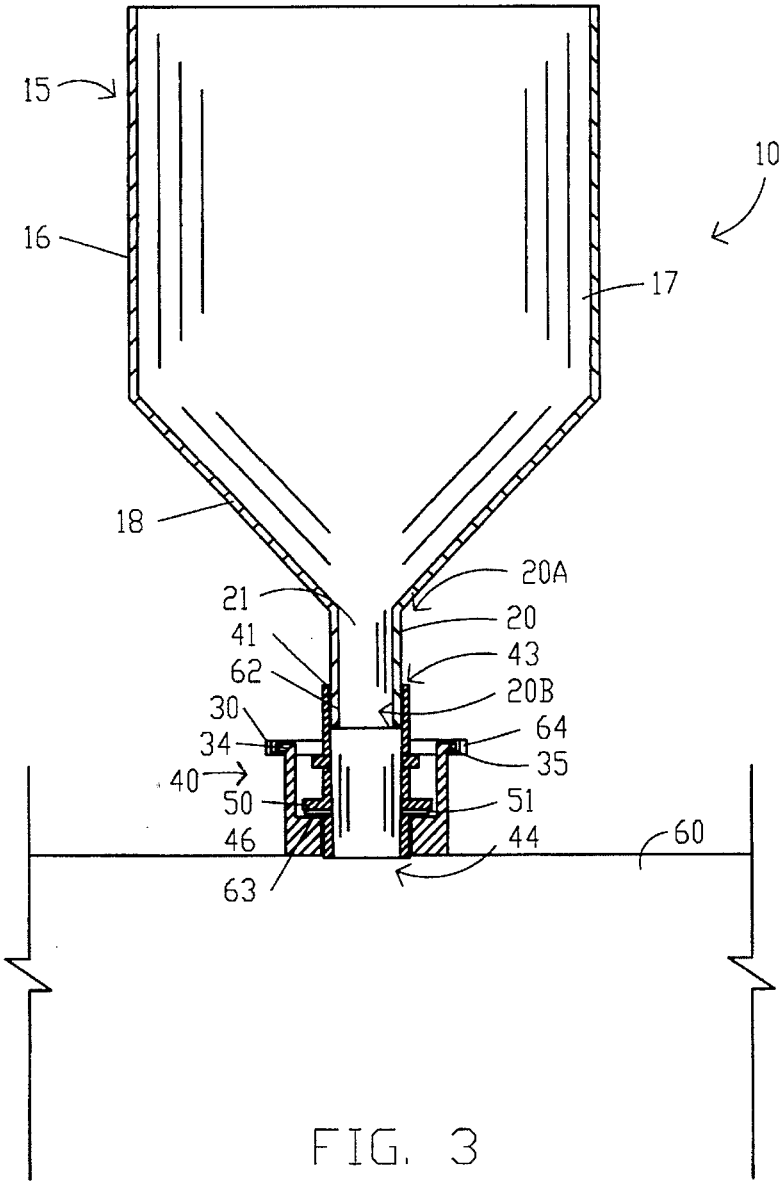
FIG. 3 is a cross-sectional view of the radiator funnel and adapter means and a radiator.
Figure 4:
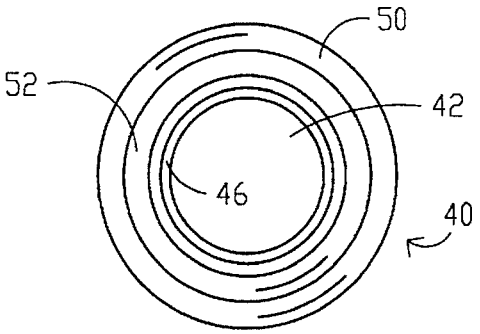
FIG. 4 is a top plan view of the adapter means.

Referring to the drawings in FIGS. 1 thru 4, in particular, the radiator funnel and adapter means 10 comprises a funnel 15 having a fluid receiving body 16 which has a side wall 17 and a tapered bottom wall 18 with the funnel 15 further having a spout 20 integral to the bottom wall 18 of the fluid receiving body 16 and extending therefrom with a bore 21 extending through the spout 20 which is tapered downward from the bottom wall 18 of the fluid receiving body or inlet end 20A of the spout 20 to the outlet end 20B of the spout 20 which is dimensioned and adapted to sealingly and engageably fit in the adapter means 40 which comprises a tubular member 41 having a bore 42 therethrough and being insertable in the fill opening 62 of the radiator 60. The bore 42 is defined by the inner side 46 of the wall 45 of the tubular member 41, which is slightly tapered inwardly from the top end 43 of the tubular member 41 to the bottom end 44 thereof to sealingly and engageably receive the spout 20 of the funnel 15.

An annular sealing flange 50 is integral to the outer side 47 of the wall 45 of the tubular member 41 for holding and restraining a flexible seal member 51 such as an O-ring which fits about the tubular member 41 and tightly abuts against the sealing flange 50 and against the annular recessed ledge 63 commonly found in the fill openings of the radiators when the adapter means 40 is inserted in the fill opening 62 of the radiator 60 to substantially prevent any fluid such as coolants or anti-freezes from leaking out of the radiator 60 between the adapter means 40 and the fill opening 62 during the filling of the radiator 60 with fluid. A cap abutment member 52 such as an annular flange is also integral to the outer side 47 of the wall 45 of the tubular member 41 and is disposed nearer to the top end 43 of the tubular member 41 than is the sealing flange 50. A cap 30 having a hole 33 through the top 31 thereof for receiving the top end 43 of the tubular member 41 and the spout 20 of the funnel 15, has a pair of fastening flanges 34 & 35 extending toward one another from opposite edges of the cap 30 below the top 31 of the cap 30 for securing the cap 30 onto the circular lip portion 64 defining the fill opening 62 of the radiator 60.

In operation, the adapter means 40 is inserted in the fill opening 62, and the cap 30 is screwed and secured onto the lip portion 64 of the fill opening 62, and as it is turned onto the lip portion 64, it urges against the cap abutment member 52 which urges the adapter means 40 and the sealing flange 50 and the flexible seal member 51 closely and tightly against the annular recessed ledge 63 in the fill opening 62 to prevent leakage of fluid between the adapter means 40 and the fill opening 62. Once the adapter means 40 and the cap 30 are secured in and upon the fill opening 62, the funnel 15 is disposed on top of the cap 30 with the spout 20 being inserted through the hole 33 in the top 31 of the cap 30 and sealingly engaged in the top end 43 and bore 42 of the tubular member 41 so that fluid cannot leak out between the spout 20 and the adapter means 40. The only outlet for fluid commonly bubbling up out of the radiator 60 during the filling of the radiator 60 is through the bore 21 of the spout 20 back into the fluid receiving body 16 of the funnel 15. This funnel and adapter means 10 substantially prevents waste of any fluid and helps protect the environment by preventing toxic radiator fluid from spilling onto and contaminating the ground soil, a problem commonly found during the filling of radiators with radiator fluids because as fluid is poured into the radiator, the fluid always bubbles up and spills out of the radiator.

To further protect against waste and spillage of fluid and to save any fluid remaining in the funnel after the radiator is filled, a stopper means 22 having a stem 23, a cylindrical plug member 24 integral to one end of the stem 23 and dimensioned and adapted to sealingly and engageably seat in the bore 21 of the spout 20, and a handle 25 integrally attached at the other end of the stem 23, can be inserted in the inlet end 20A of the spout 20 inside the area of the fluid receiving body 16 of the funnel 15 to prevent fluid remaining in the fluid receiving body 16 from draining out of the funnel 16 through the spout 20. The funnel 16 can be lifted off and removed from the adapter means 40 in the fill opening 62 of the radiator 60 and can be placed over a holding container as such; whereupon, the stopper means 22 can be removed and the fluid in the fluid receiving body 16 can be allowed to drain through the spout 20 into the holding container. The task of filling the radiator 60 is completed by the user turning off the cap 30 from the fill opening 62 of the radiator 60 and the adapter means 40 removed from the fill opening 62 and the radiator cap securely fastened over the fill opening 62 of the radiator 60.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A radiator funnel and adapter means comprising:

a funnel having a spout with a bore therethrough;

an adapter means comprising a tubular member having a top end and a bottom end and further having a bore therethrough, said bore of said adapter means being tapered inwardly from said top end to said bottom end to sealingly and engageably receive said spout of said funnel so as to substantially prevent fluid from leaking out between said spout and said adapter means, said adapter means being removably and securely disposed in a fill opening of a radiator such that said adapter means substantially prevents fluid in said radiator from leaking out between itself and said radiator, said tubular member having a sealing flange with a flexible seal member being about said tubular member for substantially preventing fluid in said radiator from leaking out of said radiator between said adapter means and said radiator, said adapter means further comprising a cap abutment member disposed about the outer side of said tubular member and a cap having a hole through a top thereof and through which a portion of said tubular member is extendable, said cap being fastenable upon said fill opening of said radiator and engageable to said cap abutment member for urging said flexible seal member tightly against said radiator so that fluid in said radiator cannot leak out between said adapter means and said radiator; and a stopper means insertable in said bore of said spout to prevent fluid in said funnel from being dispensed through said spout.

2. A radiator funnel and adapter means as described in claim 1, wherein said cap abutment member extends outward from the outer side of said tubular member and is engageable to said cap when said cap is removeably fastened upon said radiator.

3. A radiator funnel and adapter means as described in claim 1, wherein said flexible seal member is essentially engageable to a recessed ledge in said fill opening of said radiator.

4. A radiator funnel and adapter means as described in claim 3, wherein said sealing flange extends outward from the outer side of said tubular member and is engageable to said flexible seal for urging said flexible seal tightly against said recessed ledge in said fill opening of said radiator.

* * * * *